US011981531B2

(12) United States Patent
Suzuki et al.

(10) Patent No.: US 11,981,531 B2
(45) Date of Patent: May 14, 2024

(54) SHEET FEEDING DEVICE AND IMAGE FORMING APPARATUS

(71) Applicants: Ryo Suzuki, Kanagawa (JP); Ryohei Morisaki, Kanagawa (JP); Kenji Hari, Kanagawa (JP); Nagayasu Yoshida, Kanagawa (JP); Katsuji Yamaguchi, Kanagawa (JP)

(72) Inventors: Ryo Suzuki, Kanagawa (JP); Ryohei Morisaki, Kanagawa (JP); Kenji Hari, Kanagawa (JP); Nagayasu Yoshida, Kanagawa (JP); Katsuji Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 155 days.

(21) Appl. No.: 17/684,722

(22) Filed: Mar. 2, 2022

(65) Prior Publication Data

US 2022/0297963 A1 Sep. 22, 2022

(30) Foreign Application Priority Data

Mar. 17, 2021 (JP) ..... 2021-043442

(51) Int. Cl.
*B65H 7/14* (2006.01)
*B65H 1/14* (2006.01)

(52) U.S. Cl.
CPC ..... *B65H 7/14* (2013.01); *B65H 1/14* (2013.01); *B65H 2404/10* (2013.01); *B65H 2553/412* (2013.01); *B65H 2553/414* (2013.01)

(58) Field of Classification Search
CPC ..... B65H 1/14; B65H 7/14; B65H 2553/412; B65H 2553/414
USPC ..... 271/3.15, 10.02, 258.01, 265.01
See application file for complete search history.

(56) References Cited

U.S. PATENT DOCUMENTS 5,897,112 A * 4/1999 Kwag ..... B65H 1/266 271/38
7,460,825 B2 * 12/2008 Sawanaka ..... G03G 15/607 271/259
7,753,360 B2 * 7/2010 Takeuchi ..... B65H 1/04 271/111
8,042,801 B2 * 10/2011 You ..... B65H 1/266 271/157

(Continued)

FOREIGN PATENT DOCUMENTS

JP 2007-331940 12/2007
JP 2011-132030 7/2011
JP 2014-125345 7/2014

*Primary Examiner* — Leslie A Nicholson, III
(74) *Attorney, Agent, or Firm* — Harness, Dickey & Pierce, P.L.C.

(57) ABSTRACT

A sheet feeding device feeds a sheet in a feed direction. The sheet feeding device includes a loading portion, a feeler, and a first detection sensor. The sheet is to be placed on the loading portion. The feeler rotates from a reference position to a pushed position around a support shaft in response to a push by a downstream end of the sheet, which is placed on the loading portion, in the feeding direction. The first detection sensor detects a rotation of the feeler from one of the reference position and the pushed position to the other of the reference position and the pushed position. The loading portion includes a second detection sensor to detect a state in which the sheet is placed on the loading portion.

11 Claims, 5 Drawing Sheets

(56) References Cited

U.S. PATENT DOCUMENTS

| | | | | |
|---|---|---|---|---|
| 8,743,431 | B2 * | 6/2014 | Hayasaka | B65H 3/0607 399/361 |
| 9,670,015 | B2 * | 6/2017 | Hara | B65H 1/266 |
| 10,392,209 | B2 * | 8/2019 | Heishi | H04N 1/00602 |
| 11,115,561 | B2 * | 9/2021 | Tsukahara | H04N 1/00092 |
| 11,611,673 | B2 * | 3/2023 | Shirasaki | H04N 1/00644 |
| 11,691,833 | B2 * | 7/2023 | Nishii | B65H 3/0669 270/1.01 |
| 2015/0321872 | A1 | 11/2015 | Hari et al. | |
| 2020/0307944 | A1 | 10/2020 | Shibasaki et al. | |
| 2021/0087007 | A1 | 3/2021 | Morisaki et al. | |
| 2021/0107761 | A1 | 4/2021 | Hari et al. | |

* cited by examiner

SHEET FEEDING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2021-043442, filed on Mar. 17, 2021, in the Japan Patent Office, the entire disclosure of which is incorporated by reference herein.

BACKGROUND

Technical Field

Embodiments of the present disclosure relate to a sheet feeding device such as a document feeder that feeds a sheet such as a document, and an image forming apparatus such as a copier, a printer, a facsimile, or a multifunction peripheral or printer thereof including the sheet feeding device.

Related Art

Conventionally, in image forming apparatuses such as copiers, printers, and printers, document feeders serving as sheet feeding devices that feed a document as a sheet have been widely used.

For example, a technique has been proposed in which, in an auto document feeder (ADF), when a document (sheet) is placed on a document table (serving as a loading portion), a setting feeler (serving as a feeler) is pushed and moved by the sheet to rotate from a document unset position (e.g., a reference position) to a document set position (e.g., a pushed position), and the rotated state is optically detected by a document set sensor. When the document is detected by the document set sensor in such a manner, a sheet feeding operation of the document feeder is started in response to the detection.

SUMMARY

According to an embodiment of the present disclosure, there is provided a sheet feeding device that feeds a sheet in a feed direction. The sheet feeding device includes a loading portion, a feeler, and a first detection sensor. The sheet is to be placed on the loading portion. The feeler rotates from a reference position to a pushed position around a support shaft in response to a push by a downstream end of the sheet, which is placed on the loading portion, in the feeding direction. The first detection sensor detects a rotation of the feeler from one of the reference position and the pushed position to the other of the reference position and the pushed position. The loading portion includes a second detection sensor to detect a state in which the sheet is placed on the loading portion.

According to another embodiment of the present disclosure, there is provided an image forming apparatus including the sheet feeding device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
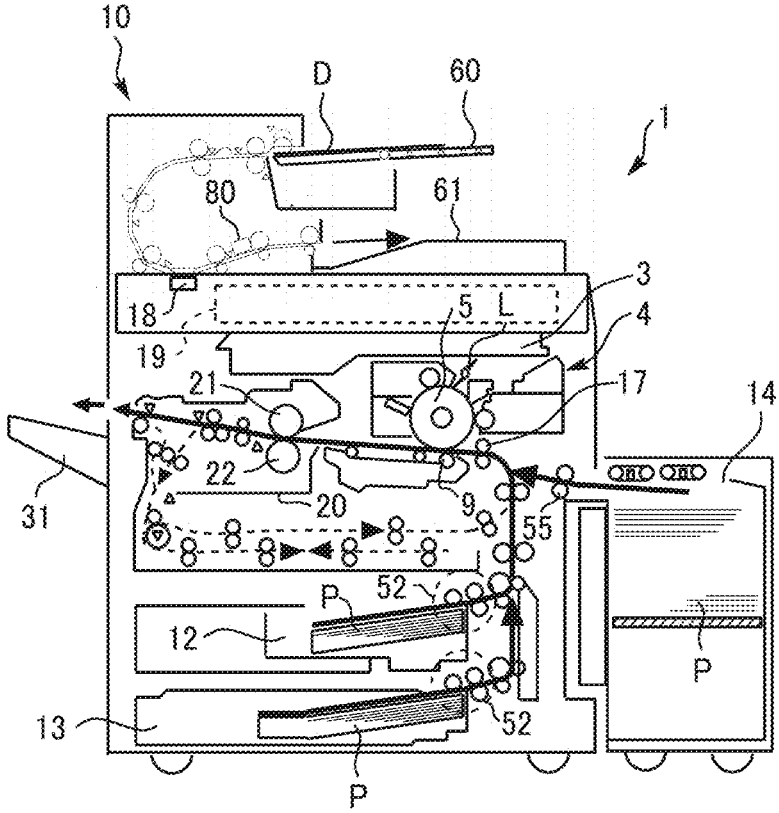
FIG. 1 is a diagram illustrating an overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Below, embodiments of the present disclosure are described in detail with reference to the drawings. Note that identical reference numerals are assigned to identical or equivalent components and a description of those components may be simplified or omitted.

First, with reference to FIG. 1, a description is given of an overall configuration and an operation of an image forming apparatus 1 according to an embodiment of the present disclosure.

In FIG. 1, the image forming apparatus 1 illustrated as a copier includes an exposure device 3, an image forming device 4, a photoconductive drum 5, and a transfer device 9. The exposure device 3 irradiates the photoconductive drum 5 with exposure light L based on image information read by image readers 18 and 80. The image forming device 4 forms a toner image (image) on the photoconductive drum 5. The transfer device 9 serving as an image forming unit transfers the toner image formed on the photoconductive drum 5 to a sheet P.

The image forming apparatus 1 further includes a document feeder (or auto document feeder (ADF)) 10, sheet feeders 12 to 14, and a pair of registration rollers 17. The document feeder 10 serving as a sheet feeding device feeds a document D (e.g., an original sheet) set on the document loading tray 60 and ejects the document D to the document ejection tray 61. The sheet feeders 12 to 14 store sheets P therein. The pair of registration rollers 17 serving as a timing roller pair conveys the sheet P toward the transfer device 9.

The image forming apparatus 1 further includes a first image reader 18, a fixing device 20, a sheet ejection tray 31, and a second image reader 80. The first image reader 18 optically reads image information on the front surface of the document D. The fixing device fixes the toner image (unfixed image) borne on the sheet P. The sheet P is ejected from a apparatus body of the image forming apparatus 1 and is stacked on the sheet ejection tray 31. The second image reader 80 optically reads image information on the back surface of the document D.

With reference to FIG. 1, a description is given of a basic image forming operation of the image forming apparatus 1.

First, a document D as a sheet is conveyed (fed) from the document loading tray 60 as a loading portion in the document feeder 10 and passes through the position of the first image reader 18. At this time, the first image reader 18 optically scans image information on the front surface of the document D passing therethrough.

The optical image data scanned by the first image reader 18 is converted to electrical signals. The converted electrical signals are transmitted to the exposure device 3. The exposure device 3 emits exposure light (laser light) L based on the image data of the electrical signals, toward the surface of the photoconductive drum 5 of the image forming device 4.

Meanwhile, while the photoconductive drum 5 rotates in a clockwise direction in FIG. 1, the image forming device 4 performs a series of image forming processes, such as a charging process, an exposing process, and a developing process, to form a toner image corresponding to the image data on the photoconductive drum 5.

Thereafter, the image formed on the photoconductive drum 5 is transferred, at a position of the transfer device 9, onto the sheet P conveyed by the pair of registration rollers 17.

Now, a description is given of how the sheet P is conveyed to the transfer device 9 as an image forming unit.

First, one of the sheet feeders 12, 13, and 14 disposed inside the apparatus body of the image forming apparatus 1 is selected automatically or manually. For example, if the uppermost sheet feeder 12 is selected, an uppermost sheet P accommodated in the first sheet feeder 12 is fed by a sheet feeding mechanism 52 (including, e.g., a sheet feed roller, a pickup roller, and a backup roller) to a sheet conveyance passage. The uppermost sheet P passes through the sheet conveyance passage, in which multiple sheet conveying rollers are disposed, and then reaches the pair of registration rollers 17.

After reaching the pair of registration rollers 17, the uppermost sheet P is conveyed toward the transfer device 9 (serving as an image forming unit) in synchronization with movement of the toner image formed on the surface of the photoconductive drum 5, thus causing the toner image to be placed on the sheet P.

After the transfer device 9 transfers the toner image from the photoconductive drum onto the sheet P, the sheet P is conveyed to the fixing device 20 along a sheet conveyance passage. In the fixing device 20, the sheet P is conveyed between the fixing roller 21 and the pressure roller 22. The toner image is fixed onto the sheet P under heat applied by the fixing roller 21 and pressure applied by the fixing roller 21 and the pressure roller 22, which is a fixing process. After the fixing process, the sheet P, on which the toner image has been fixed, is fed from a fixing nip between the fixing roller 21 and the pressure roller 22 and is ejected from the apparatus body of the image forming apparatus 1. Then, the sheet P is stacked as an output image, on a sheet ejection tray 31.

Thus, a series of image forming processes is completed.

Note that in a case where image formation is performed based on an image on the back side in addition to the front surface of the document D, the second image reader 80 optically reads image information on the back surface of the document D passing below the second image reader 80 via the position of the first image reader 18 in the document feeder 10. Next, in the same manner as the image forming process based on the image on the front side, the optical image data scanned by the second image reader 80 is transmitted to the exposure device 3, and the image forming process is performed based on the optical image data.

Next, a configuration and an operation of the document feeder 10 serving as a sheet feeding device are described in detail with reference to FIG. 2.

Figure 2:
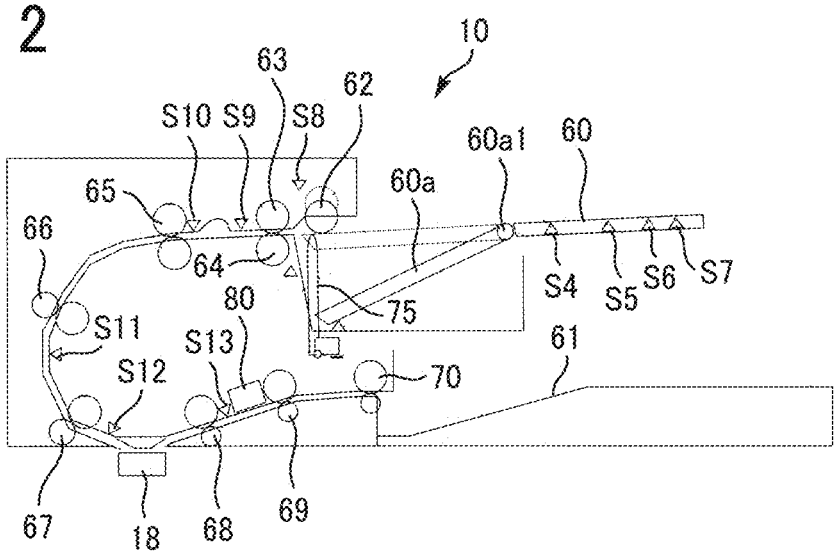
FIG. 2 is a schematic view of a document feeder according to an embodiment of the present disclosure.

As illustrated in FIG. 2, the document feeder 10 includes the document loading tray 60 (serving as a loading portion), the first image reader 18, the second image reader 80, the document ejection tray 61 (serving as a sheet ejection tray), a pickup roller 62, a sheet feed roller 63, a reverse roller 64, a plurality of pairs of conveyance rollers 65 to 69, a pair of ejection rollers 70 (serving as a pair of sheet ejection rollers), size detection sensors S4 to S7, and document detection sensors S8 to S13.

Figure 3:
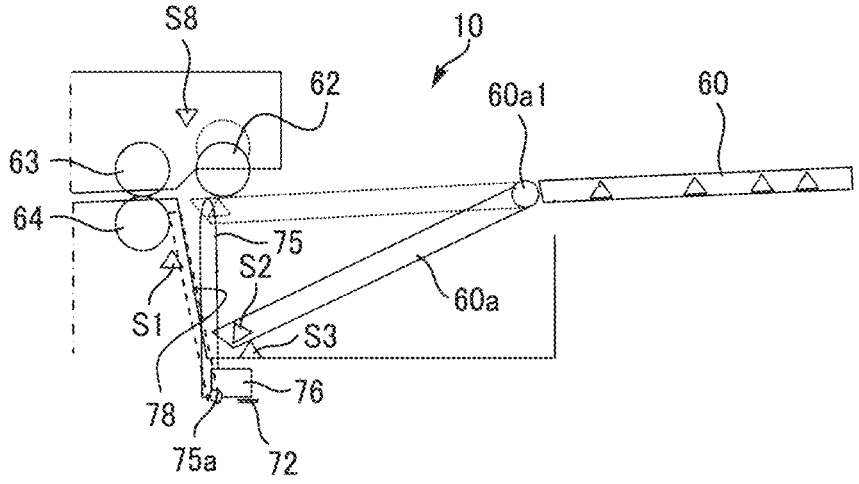
FIG. 3 is an enlarged view of a part of the document feeder illustrated in FIG. 2.

Here, the document loading tray 60 as the loading portion is provided with an upwardly-open space and is configured such that the user can place the document D from above with the front surface facing upward (in other words, can stack a bundle of a plurality of the document D). Note that the document loading tray 60 is provided with a pair of side fences for determining the position of the placed document D in the width direction that is a direction orthogonal to the feeding direction, a direction perpendicular to the plane on which FIGS. 1 to 3 are drawn, and the up/down direction of FIG. 4).

The document ejection tray 61 is disposed below the document loading tray 60, and is configured such that the document D whose image has been scanned by the first image reader 18 or the second image reader 80 is ejected and placed thereon (in other words, configured such that a plurality of documents D are stacked).

In a conveyance passage from the document loading tray 60 to the document ejection tray 61, the pickup roller 62, the sheet feed roller 63 and the reverse roller 64, a first pair of conveyance rollers 65 (an contact roller pair), a second pair of conveyance rollers 66, a third pair of conveyance rollers 67, a fourth pair of conveyance rollers 68, a fifth pair of conveyance rollers 69, and the pair of ejection rollers 70 are disposed in this order from the upstream side in the conveyance direction. These rollers 62 to 70 function as conveyors that convey the document D placed on the document loading tray 60 toward the positions of the first image reader 18 and the second image reader 80 and convey the document D after image scanning toward the document ejection tray 61.

In the conveyance passage formed by these rollers 62 to 70, as illustrated in FIG. 2, a plurality of guide plates that guide the conveyance of the document D are disposed substantially in parallel on a side facing the front surface and a side facing the back surface of the document D.

Here, the plurality of pairs of conveyance rollers 65 to 69 (in particular, three pairs of conveyance rollers 67 to 69 related to scanning accuracy at the positions of the first image reader 18 and the second image reader 80) convey the document D at a predetermined conveyance speed (constant speed) at the position of the first image reader 18 or the second image reader 80. The first image reader 18 is disposed so as to face the front surface of the document D in a conveyance passage between the third pair of conveyance rollers 67 and the fourth pair of conveyance rollers 68, and the second image reader 80 is disposed so as to face the back surface of the document D in a conveyance passage between the fourth pair of conveyance rollers 68 and the fifth pair of conveyance rollers 69.

The pair of ejection rollers 70 is disposed downstream from the fifth pair of conveyance rollers 69, which is located most downstream in the conveyance direction among the plurality of pairs of conveyance rollers 65 to 69, in the conveyance direction and at a position of a document ejection port. The document D, an image of which has been scanned at the positions of the first image reader 18 and the second image reader 80, is conveyed and ejected (stacked) toward the document ejection tray 61 by the pair of ejection rollers 70.

Note that as illustrated in FIG. 2, the document loading tray 60 is provided with a plurality of document detection sensors S8 to S13 that are disposed along the conveyance passage of the document D. The document detection sensors S8 to S13 are reflection-type photosensors and are used to detect the presence or absence of a jam of the document D (document jam) in the conveyance passage and to control, for example, the timing of conveyance to the first image reader 18 or the second image reader 80 and the timing of reading by the first image reader 18 or the second image reader 80.

As illustrated in FIG. 2, the document loading tray 60 is also provided with a plurality of size detection sensors S4 to S7 that are arranged in parallel along the feeding direction and on the upstream side (the right side in FIG. 2 and a stationary part of the loading portion other than a lifting loading portion 60*a*) in the feeding direction. The size detection sensors S4 to S7 are reflection-type photosensors and are used to optically detect the rear end (an upstream end in the feeding direction) of the document D placed on the document loading tray 60 to detect the size of the document D.

Basic operations of the document feeder 10 configured as described above are described below.

First, when a document D (at least one with an image formed on its front surface) is stacked on the document loading tray 60 with a front surface of the document D up such that a leading end of the document D (i.e., a leading end in the feeding direction) contacts a reference wall 78 (see FIGS. 3 and 4), the lifting loading portion 60*a* of the document loading tray 60 moves upward (i.e., rotates clockwise from the standby position indicated by the solid line to the feeding position indicated by the broken line in FIG. 2). Next, when an instruction (a copy instruction) to scan the image of the document D is sent by operation of the operation panel, documents D are sequentially conveyed by the pickup roller 62 from the top on the document loading tray 60 toward the nip between the sheet feed roller 63 and the reverse roller 64. At this time, although there is a possibility that a plurality of documents D are conveyed toward the nip between the sheet feed roller 63 and the reverse roller 64, only the uppermost document D is separated by the feed-and-reverse-roller (FRR) type separation in the sheet feed roller 63 and the reverse roller 64 and is sent to a downstream conveyance passage.

Note that in the present embodiment, the pickup roller 62 is configured to be movable up and down by a movement mechanism. The pickup roller 62 moves from the standby position illustrated by the broken lines in FIGS. 2 and 3 so as to contact the surface of the uppermost document D on the document loading tray 60 when the feeding operation is started.

Thereafter, the document D conveyed to the conveyance passage contacts a nip of the first pair of conveyance rollers 65 (serving as a contact roller pair) in a rotation stopped state, and skew correction (skewing correction) is performed. Thereafter, the document D subjected to the skew correction is conveyed to a downstream side by the first pair of conveyance rollers 65 having started rotation, passes the position of a document detection sensor S10 (serving as a registration sensor), is conveyed by the second pair of conveyance rollers 66 and the third pair of conveyance rollers 67, and is conveyed to the position of the first image reader 18 while being guided by a conveyance guide plate. The image on the front surface of the document D is optically scanned at the position of the first image reader 18.

Thereafter, the document D from which the image has been read is conveyed to the position of the second image reader 80 by the third pair of conveyance rollers 67 and the fourth pair of conveyance rollers 68. Next, at the position of the second image reader 80, the image on the back surface of the document D is optically scanned. Note that in a case where the image information on the back surface of the document D is not scanned (i.e., in a case where a mode for scanning only the image information on the front surface is set), the image reading by the second image reader 80 as described above is not performed, and the document D passes the position of the second image reader 80 as it is.

Thereafter, the document D is conveyed by the fourth pair of conveyance rollers 68 and the fifth pair of conveyance rollers 69 to the position of the pair of ejection rollers 70. The sheet is ejected onto the document ejection tray 61 by conveyance by the pair of ejection rollers 70.

In a case where a plurality of documents D are stacked on the document loading tray 60 and images are formed on the documents D, the plurality of documents D on the document loading tray 60 are continuously conveyed at intervals, and a series of document conveyance operations as described above is repeatedly performed.

Hereinafter, a configuration and an operation of the document feeder 10 as a sheet feeding device according to the present embodiment are described in detail with reference to FIGS. 3 to 5.

In the present embodiment, the document feeder 10 described above with reference to FIG. 2 and so forth functions as a sheet feeding device that feeds a document D as a sheet in a predetermined feeding direction.

The document feeder 10 as a sheet feeding device includes the document loading tray 60 as a loading portion on which a document D (an example of a sheet) can be placed.

Here, the document loading tray 60 (serving as a loading portion) according to the present embodiment is provided with the lifting loading portion 60*a* that raises the document D (sheet) placed on the document loading tray 60 from the standby position (position indicated by solid lines in FIGS. 2 and 3) to the feeding position (position indicated by broken lines in FIGS. 2 and 3) when the feeding operation described above with reference to FIG. 2 is started.

The lifting loading portion 60*a* is configured to be rotatable (movable up and down) around a rotation shaft 60*a*1 positioned at a border with a fixed portion in the document loading tray 60 by driving of a motor. The lifting loading portion 60*a* is rotated (moved up and down) so as to be placed at the standby position indicated by the solid line in FIG. 3 when the document D is not set on the document loading tray 60 and to be placed at the feeding position indicated by the broken line in FIG. 3 when the document D is set on the document loading tray 60. Providing such a lifting loading portion 60*a* enhances the setting performance of the document D on the document loading tray 60.

Note that whether the document D is placed on the document loading tray 60 is detected by a first detection sensor S1 (or a second detection sensor S2).

Further, the state in which the lifting loading portion 60*a* is located at the standby position is detected by a lifting home-position sensor S3. Furthermore, the state in which the uppermost document D on the lifting loading portion 60*a* is located at the feeding position is detected by the document detection sensor S8.

Figure 4:
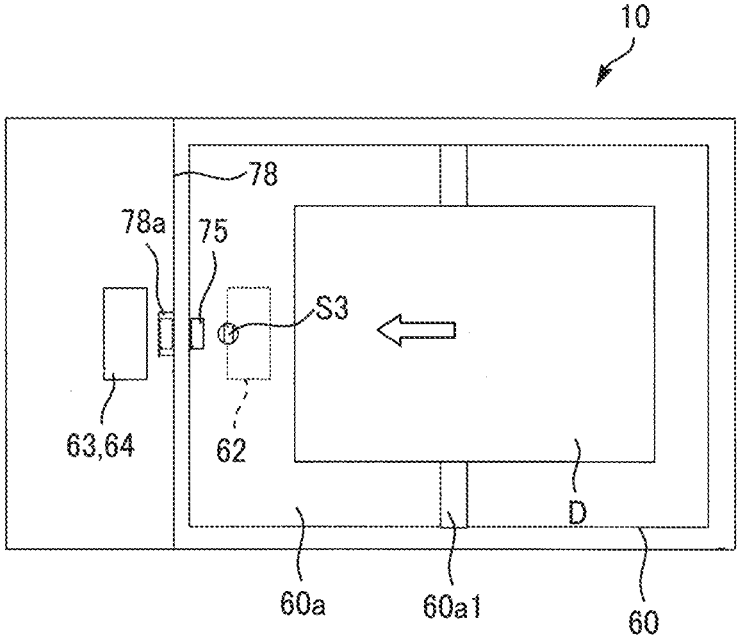
FIG. 4 is a top view of the part of the document feeder illustrated in FIG. 3.
Figure 5:
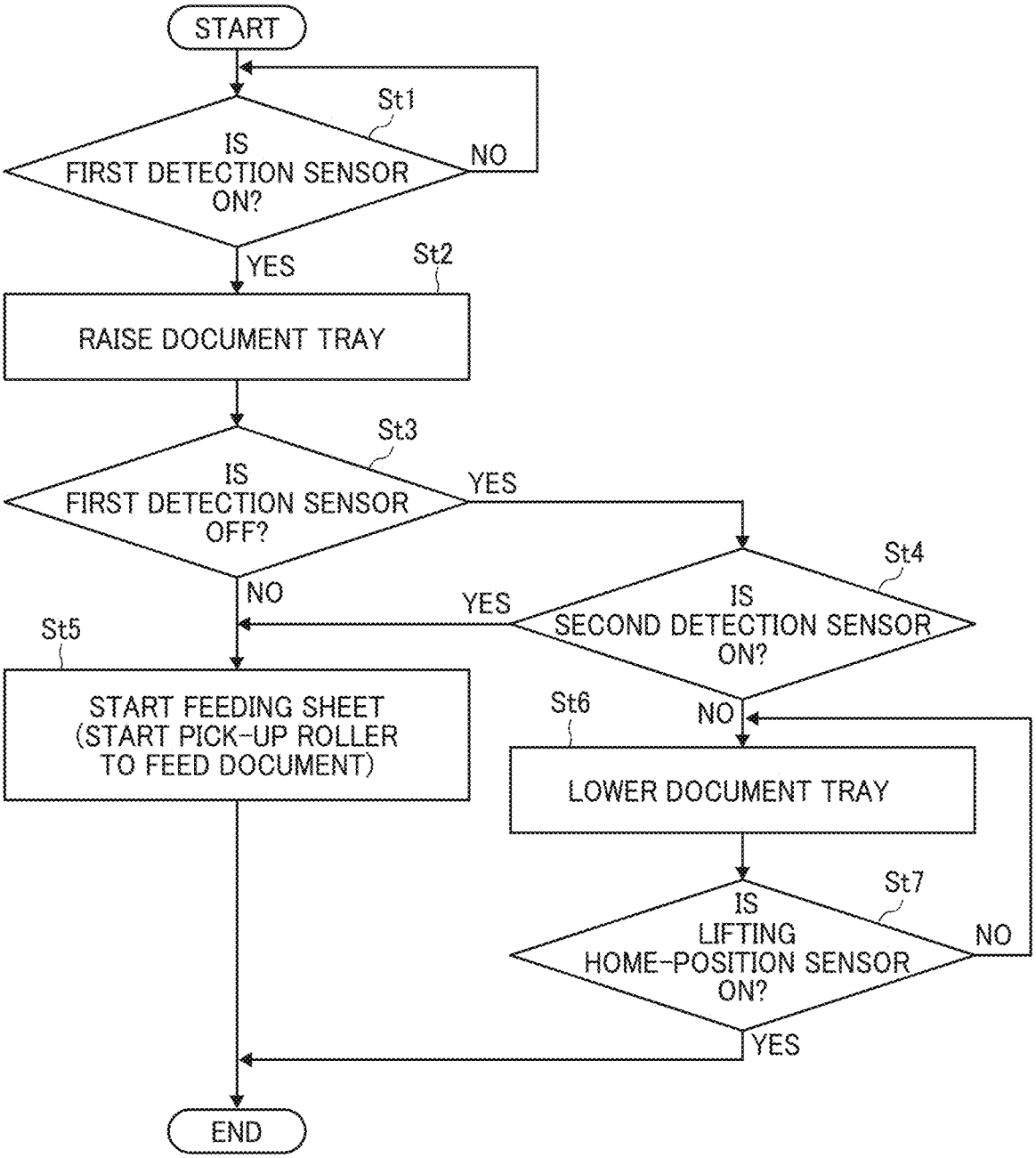
FIG. 5 is a flowchart illustrating an example of control performed in a document feeder, according to an embodiment of the present disclosure.

Here, with reference to FIGS. 3 and 4 and the like, the document feeder 10 serving as the sheet feeding device according to the present embodiment includes a feeler 75 (serving as a movable member) and the first detection sensor S1 (serving as a first detector).

The feeler 75 is pushed by a downstream end in the feeding direction of the document D (sheet) placed on the document loading tray 60, and rotates about a support shaft 75*a* from a reference position (a position indicated by solid lines in FIGS. 3 and 4) to a pushed position (a position indicated by broken lines in FIGS. 3 and 4 and a detection position of the first detection sensor S1).

The first detection sensor S1 detects rotation of the feeler 75 from the reference position (or the pushed position) to the pushed position (or the reference position).

For example, the feeler 75 is provided at its lower part with a weight 76 for maintaining the posture at the reference position. Note that when the feeler 75 is located at the reference position, the weight 76 contacts a stopper 72 formed in a housing so that the feeler 75 does not rotate in the clockwise direction in FIG. 3 beyond the reference position.

The first detection sensor S1 is a transmission-type photosensor, and is disposed in a recess 78*a* of the reference wall 78 (see FIG. 4). The recess 78*a* of the reference wall 78 is formed so as to be recessed toward the downstream side from the reference wall 78 in the feeding direction, and stores the feeler 75 so that the feeler 75 rotated to the pushed position does not protrude toward the upstream side from the reference wall 78 (does not interfere with the feeding of the document D).

Next, as described above, when the document D is set on the document loading tray 60 such that the leading end of the document D, which is the left end in FIGS. 3 and 4, contacts the reference wall 78, the feeler 75 is pushed by the leading end of the document D and rotates in the counterclockwise direction in FIG. 3 around the support shaft 75*a*. When the feeler 75 rotates to the pushed position, the feeler 75 enters a space between a light emitting element and a light receiving element in the first detection sensor S1, and the sensor output changes (changes from an off-state to an on-state). Thus, the document D is detected to have been set on the document loading tray 60.

Note that when the document D on the document loading tray 60 runs out and the feeler 75 located at the pushed position (detection position) rotates toward the reference position, the sensor output of the first detection sensor S1 changes (changes from the on-state to the off-state), and it is detected that the document D is not set on the document loading tray 60. In this specification, such a state is referred to as a "state in which the first detection sensor S1 detects the rotation of the feeler 75 from the pushed position to the reference position".

Here, the document loading tray 60 (loading portion) of the document feeder 10 (sheet feeding device) according to the present embodiment is provided with the second detection sensor S2 that detects a state where the document D (sheet) is placed on the document loading tray 60.

Specifically, the second detection sensor S2 is disposed in the vicinity of the upstream side (the right side in FIGS. 3 and 4) from the feeler 75 and the first detection sensor S1 in the feeding direction. This positional relationship (which is a relationship in which the second detection sensor S2 is positioned upstream from the feeler 75) does not change regardless of whether the lifting loading portion 60*a* is raised to the feeding position or lowered to the standby position. The position of the second detection sensor S2 in the feeding direction is set to a position where, on the assumption that the feeler 75 is fixed to the reference position, the document D can be detected in a state where the leading end of the document D is in contact with the feeler 75 and the document D in the state can be fed by the pickup roller 62 at the feeding position.

In the present embodiment, a reflection-type photosensor (in which light emitted from a light-emitting element is reflected off an object to be detected and is received by a light-receiving element) is used as the second detection sensor S2.

For example, when a document D is set on the loading surface of the document loading tray 60, light emitted from the light emitting element in the second detection sensor S2 is reflected off the document D and the reflection light is received by the light receiving element. Accordingly, the sensor output changes (from an off-state to an on-state). Thus, the document D is detected to have been set on the document loading tray 60.

The second detection sensor S2 (serving as a reflection-type photosensor) is disposed such that the detection surface is positioned on the same plane as or lower than the loading surface (upper surface) of the document loading tray 60. For example, as illustrated in FIG. 4, the detection surface (which is a sensor surface capable of emitting light from the light emitting element and receiving light reflected from an object to be detected by the light receiving element) of the second detection sensor S2 is formed so as to be exposed from an opening formed in the lifting loading portion 60*a* without protruding.

Such a configuration prevents the occurrence of a failure in which the document D is caught by the second detection sensor S2 in a feeding operation, a document setting operation, or the like.

Note that the second detection sensor S2 (serving as a reflection-type photosensor) preferably has little effect on ambient light in order to prevent its erroneous detection.

In the present embodiment, after the first detection sensor S1 detects the rotation of the feeler 75 from the reference position to the pushed position (the rotation from the position indicated by the solid line to the position indicated by the broken line in FIG. 3 about the support shaft 75*a*), the first detection sensor S1 may detect the rotation of the feeler 75 from the pushed position to the reference position (the rotation from the pushed position). Even in such a case, if the second detection sensor S2 continues to detect the document D (sheet) placed on the document loading tray 60, the feeding operation is controlled to start with the assumption that the document D is placed on the document loading tray 60 (the document D is not depleted).

That is, in the present embodiment, even if the document set state by the first detection sensor S1 is cancelled from a state in which the document set state is detected by the first detection sensor S2 and the second detection sensor S1 (even if the document unset state is detected), the second detection sensor S2 may continue to detect the document set state. In such a case, the subsequent feeding operation is performed without interruption on the assumption that the document is in the document set state.

Such control is performed because of the following reason. For example, when a lightweight document such as thin paper or small-size paper is set as the document D on the document loading tray 60, the feeler 75 rotates to the pushed position (detection position) by a user pushing the document D and the pushed state is detected by the first detection sensor S1. However, the document D may be slightly pushed back to the upstream side (the right side in FIGS. 3 and 4, which is a direction away from the reference wall 78) in the feeding direction by the feeler 75 trying to return to the reference position at the moment when the user releases his/her hand from the document D. In such a case, the feeler 75 is separated from the first detection sensor S1, and the first detection sensor S1 detects that the document is not set. However, even if the document D is slightly separated from the reference wall 78 in the document loading tray 60 as described above, the pickup roller 62 can sufficiently convey the document D to the downstream side in the feeding direction. If the feeding operation is interrupted as it is, a time waste occurs. That is, in a case where the document set state is detected by only the first detection sensor S1, it is likely to be erroneously detected that the document D is not placed although the document D is placed on the document loading tray 60. In addition, such erroneous detection by the first detection sensor S1 is also likely to occur in a case where the leading end of the document D is curled (curved).

On the other hand, in the present embodiment, in addition to the detection of the document set state by the first detection sensor S1, the detection of the document set state by the second detection sensor S2 is performed. Accordingly, even if the detection of the document set state by the first detection sensor S1 is cancelled, the feeding operation is not interrupted as long as the detection of the document set state by the second detection sensor S2 is continued. Such a configuration can reduce a failure in which it is erroneously detected that the document D is not placed although the document D is placed on the document loading tray 60.

Note that if the document set state is detected with only the second detection sensor S2 without the first detection sensor S1 and the feeler 75, the detection is performed alone, and thus the second detection sensor S2 with high detection accuracy needs to be used. In such a case, if a punch hole formed in the document D is positioned on the detection surface, a possibility increases that it is erroneously detected that the document is not set. The second detection sensor S2 may also detect, as a document, a foreign object such as dust or dirt that is different from the document D. For this reason, as in the present embodiment, it is preferable to use both the detection of the document set state by the first detection sensor S1 and the feeler 75 and the detection of the document set state by the second detection sensor S2.

Here, in the present embodiment, the second detection sensor S2 can detect a state in which all of the plurality of documents D (sheets) placed on the document loading tray 60 are depleted. That is, the second detection sensor S2 also functions as an end detection sensor that detects an end state (empty state) of the document D on the document loading tray 60.

For example, when the document D on the document loading tray 60 is depleted, light emitted from the light emitting element of the second detection sensor S2 is not received by the light receiving element as reflection light, and the sensor output changes (changes from the on-state to the off-state). Thus, the end state of the document D on the document loading tray 60 is detected. When the end state is detected as such, a message indicating the end state is displayed on a display panel of the apparatus body of the image forming apparatus 1.

As described above, the feeler 75 in the first detection sensor S1 is more likely to rotate to the reference position as the weight of the document D (the force received from the document D) contacting the feeler 75 is smaller. Accordingly, as the stacked state of the document D on the document loading tray 60 approaches the end state, erroneous detection is more likely to occur that the document D is not placed although the document D is still placed on the document loading tray 60. In such a case, it is not preferable to use the first detection sensor S1 as an end detection sensor. In the present embodiment, since the second detection sensor S2 is used as the end detection sensor, the end state is less likely to be erroneously detected.

Furthermore, as illustrated in FIG. 3 and so forth, in the present embodiment, the support shaft 75*a* of the feeler 75 is positioned lower than the loading surface of the document loading tray 60.

In particular, in the present embodiment, the support shaft 75*a* of the feeler 75 is located lower than the loading surface of the lifting loading portion 60*a* located at the standby position.

Such a setting allows the feeler 75 to extend in the vertical direction to a sheet feeding position. For example, the feeler 75 is formed so as to extend in the vertical direction from a position lower than the loading surface of the lifting loading portion 60*a* located at the standby position to a sheet feeding position in the vicinity of the pickup roller 62.

Accordingly, the contact state between the document D on the document loading tray 60 and the feeler 75 can be maintained regardless of whether the lifting loading portion 60*a* ascends or descends. Thus, the document set detection can be satisfactorily performed by the first detection sensor S1.

Hereinafter, an example of control performed by the document feeder 10 using the first detection sensor S1 and the second detection sensor S2 is described with reference to FIG. 5.

First, when the first detection sensor S1 is turned on (step Sa), it is determined that the document D is placed on the document loading tray 60. The lifting loading portion 60*a* (of the document loading tray) located at the standby position is lifted (pivoted) to the feeding position (step St2).

Thereafter, it continues to be determined whether the first detection sensor S1 is not turned off (step St3). As a result, when the first detection sensor S1 is not turned off, it is determined that the push-back of the document D by the feeler 75 does not occur. The feeding operation is started as it is (step St5), and the process ends. That is, as described above with reference to FIG. 2 and so forth, the pickup roller 62 conveys the document D to the nip between the sheet feed roller 63 and the reverse roller 64, and then conveys the document D toward the first image reader 18 or the second image reader 80.

On the other hand, when the first detection sensor S1 is turned off in step St3, it is determined that the document D has been pushed back by the feeler 75 and it is determined whether the second detection sensor S2 is continuously turned on (step St4). As a result, when the second detection sensor S2 is turned on, it is determined that the document D is placed on the document loading tray 60 and the control process of step St5 and subsequent steps is performed.

On the other hand, in a case where the second detection sensor S2 is not turned on in step St4, on the assumption that no document D is placed on the document loading tray 60 (i.e., it is an end state), the lifting loading portion 60*a* (of the document loading tray) that has been at the feeding position is lowered (rotated) to the standby position until the lifting home-position sensor S3 is turned on (steps St6 and St7). Then, the process ends.

First Modification

Figure 6:
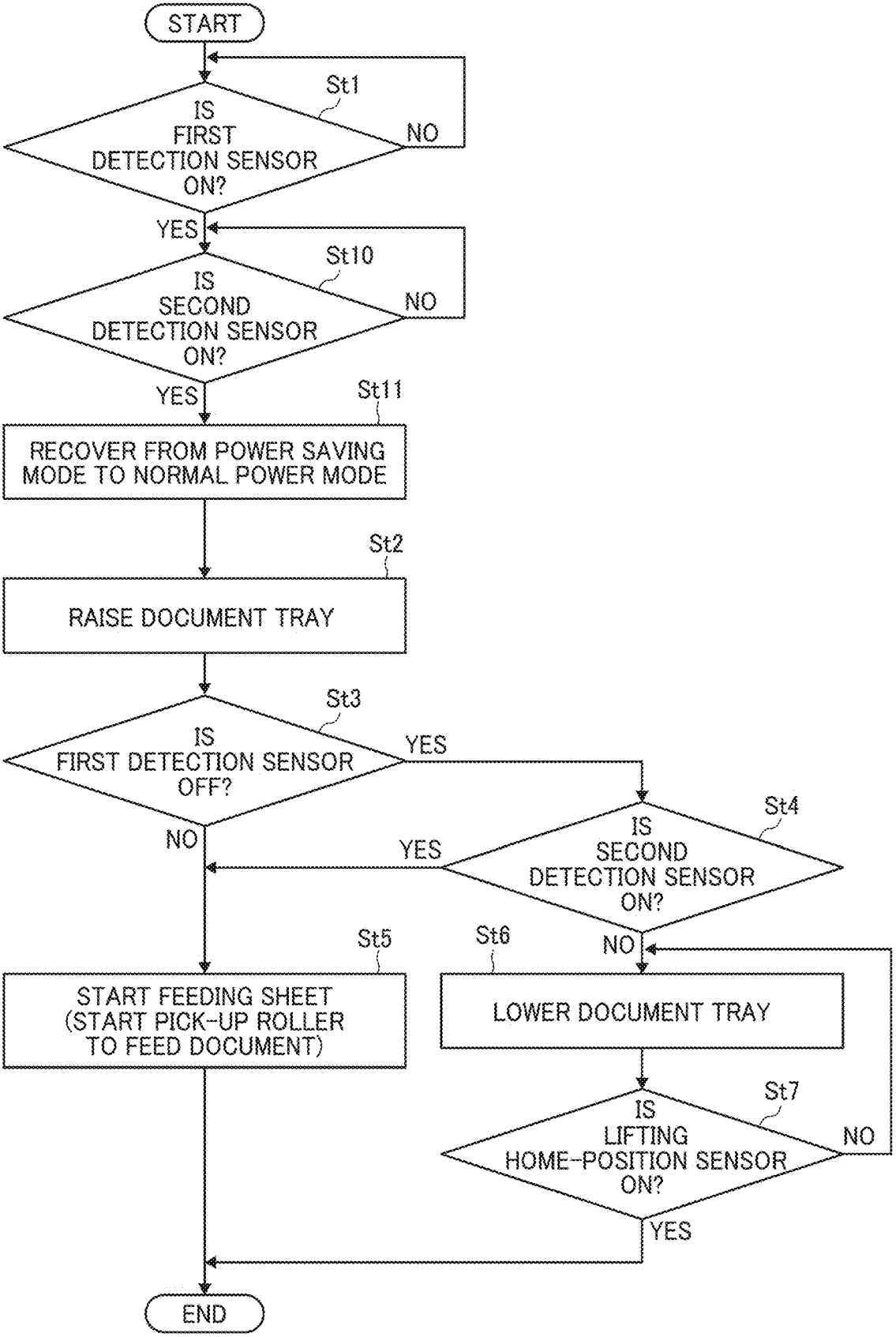
FIG. 6 is a flowchart illustrating control performed in a document feeder, according to a first modification.

With reference to FIG. 6, a document feeder 10 (or an image forming apparatus 1) according to a first modification, in response to detection of the document set state by the second detection sensor S2, recovers from a power saving mode and moves the lifting loading portion 60*a* up to the feeding position.

Specifically, the "power saving mode" is a control mode in which power consumption in the image forming apparatus 1 is controlled to be lower than that in printing (normal power mode) for the purpose of energy saving. For example, when it is determined by a timer built in the image forming apparatus 1 that the image forming apparatus 1 has not been used by a user for a predetermined time, power supply to a heater, a display panel, or the like of the fixing device 20 is interrupted (or decreased).

Next, in the first modification, when the state where the document D (sheet) is placed on the document loading tray 60 is detected by the second detection sensor S2 during execution of the power saving mode, control is performed such that the power saving mode is cancelled and the image forming apparatus 1 returns to the normal power mode for printing. Such control allows speedy return from the power saving mode in accordance with the setting operation of the document D by the user.

Furthermore, in the first modification, when the state in which the document D is placed on the document loading tray 60 is detected by the second detection sensor S2, the lifting loading portion 60*a* is controlled to be lifted up from the standby position to the feeding position. Such control allows prompt start of the feeding operation in accordance with the setting operation of the document D by the user.

Hereinafter, an example of control in the document feeder 10 in response to detection of the above-described second detection sensor S2 is described with reference to FIG. 6.

First, it is determined whether the first detection sensor S1 is on (step St1), and it is determined whether the second detection sensor S2 is on (step St10).

As a result, when it is determined that the second detection sensor S2 has been turned on, the image forming apparatus 1 returns from the power saving mode to the normal power mode (step Sal), and the lifting loading portion 60*a* (of the document loading tray) that has been at the standby position is lifted (rotated) to the feeding position (step St2).

Thereafter, the control process of step St3 and subsequent steps is performed in the same manner as described above with reference to FIG. 5.

Second Modification

Figure 7:
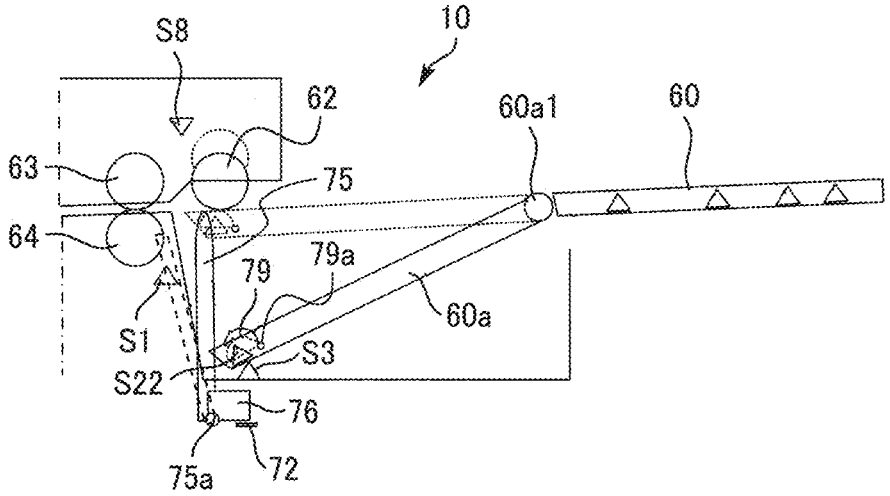
FIG. 7 is an enlarged view of a part of a document feeder according to a second modification.
Figure 8:
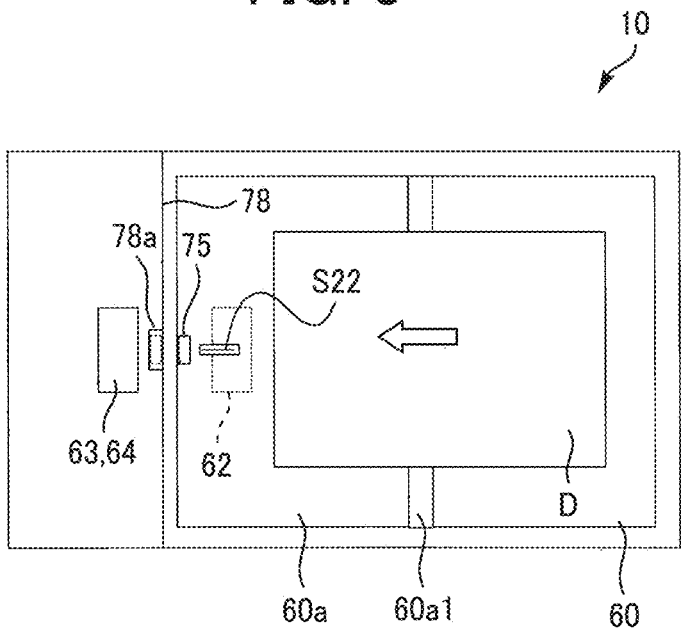
FIG. 8 is a top view of a part of the document feeder of FIG. 7.

As illustrated in FIGS. 7 and 8, a document feeder 10 (serving as a sheet feeding device) according to a second modification does not uses a reflection-type photosensor as a second detection sensor but uses a transmission-type photosensor as a second detection sensor S22.

For example, the document loading tray 60 (having the lifting loading portion 60*a*) is provided with a second feeler 79 that is pushed by a document D (sheet) placed on the document loading tray 60 and rotates about a second support shaft 79*a* from a protruding position to a non-protruding position. At the protruding position, the second feeler 79 protrudes from a loading surface of the document loading tray 60. At the non-protruding position, the second feeler 79 does not protrude from the loading surface.

The second detection sensor S22, which is a transmission-type photosensor, is disposed at a position at which the second detection sensor S22 does not protrude from the loading surface (of the lifting loading portion 60*a*) of the document loading tray 60, and detects the rotation of the second feeler 79 from the protruding position (or non-protruding position) to the non-protruding position (or protruding position).

For example, when a document D is set on the document loading tray 60, the second feeler 79 is pushed by the document D and rotates in the counterclockwise direction in FIG. 7 about the second support shaft 79*a*. When the second feeler 79 rotates from the protruding position to the non-protruding position, the second feeler 79 enters a space between the light emitting element and the light receiving element of the second detection sensor S22. Accordingly, the sensor output changes (changes from an off-state to an on-state). Thus, the document D is detected to have been set on the document loading tray 60.

Note that when the document D on the document loading tray 60 runs out and the second feeler 79 located at the non-protruding position (detection position) rotates toward the protruding position, the sensor output of the second detection sensor S22 changes (changes from the on-state to the off-state), and it is detected that the document D is not set on the document loading tray 60. Thus, an end state is detected.

Next, also in the second modification, in addition to the detection of the document set state by the first detection sensor S1, the detection of the document set state by the second detection sensor S22 is performed. Accordingly, even if the detection of the document set state by the first detection sensor S1 has been cancelled, the feeding operation is continued as long as the detection of the document set state by the second detection sensor S22 is continued. Such a configuration can reduce a failure in which it is erroneously detected that the document D is not placed although the document D is placed on the document loading tray 60.

Furthermore, the transmission-type photosensor using the second feeler 79 is used as the second detection sensor S22. Such a configuration can also reduce a failure in which a foreign object such as dust or dirt that is different from the document D is detected as the document.

As described above, the document feeder 10 according to the present embodiment is a sheet feeding device that feeds a document D (sheet) in a predetermined feeding direction, and is provided with the document loading tray 60 (serving as a loading portion) on which the document D can be placed. The document feeder 10 according to the present embodiment further includes the feeler 75 and the first detection sensor S1. The feeler 75 is pushed by the downstream end in the feeding direction of the document D placed on the document loading tray 60 and rotates from the reference position to the pushed position around the support shaft 75*a*. The first detection sensor S1 detects the rotation of the feeler 75 from the reference position (or the pushed position) to the pushed position (or the reference position). The document loading tray 60 is provided with the second detection sensor S2 that detects a state in which the document D is placed on the document loading tray 60.

Such a configuration can prevent occurrence of a failure in which it is erroneously detected that the document D is not placed although the document D is placed on the document loading tray 60.

Note that in the present disclosure, the document feeder 10 is disposed in the monochrome image forming apparatus 1. However, in some embodiments of the present disclosure, a document feeder may be disposed in a color image forming apparatus.

Furthermore, in the present embodiment, the document feeder 10 is disposed in the image forming apparatus 1 employing an electrophotographic method. However, embodiments of the present disclosure are not limited thereto, and in some embodiments, a document feeder may be disposed in an image forming apparatus employing any other method, for example, an image forming apparatus employing an inkjet method or a stencil printing machine.

Furthermore, although in the present embodiment, the document feeder 10 includes the document loading tray 60 provided with the lifting loading portion 60*a*. However, in some embodiments, a document feeder may include a document loading tray that is not provided with a lifting loading portion.

Furthermore, in the present embodiment, the document feeder 10 is provided with the second image reader 80. However, in some embodiments, a document feeder may be not provided with a second image reader.

Furthermore, the document feeder 10 serves as a sheet feeding device in the present embodiment. However, embodiments of the present disclosure are not limited thereto. For example, the sheet feeders 12 to 14 each may be configured as a sheet feeding device according to an embodiment of present disclosure that feeds sheets P as sheets.

Even in such cases, an effect similar to, even if not the same as, that of the present embodiment can be obtained.

The above-described embodiments and modifications are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited to the embodiments and thus may be preferably set to be applied to the present disclosure.

Note that in the present specification, the term "sheet" is defined as the document D set in the document feeder 10, which includes not only normal paper but also all sheet-shaped members such as coated paper, label paper, an overhead projector (OHP) transparency sheet, a film, and a sheet formed with punch holes, and furthermore includes the sheet P fed in the sheet feeders 12 to 15 serving as sheet feeding devices.

The functions of the above-described embodiments may be implemented by one or a plurality of processing circuits. Here, the processing circuit or circuitry in the present specification includes a programmed processor to execute each function by software, such as a processor implemented by an electronic circuit, and devices, such as an application specific integrated circuit (ASIC), a digital signal processor (DSP), and a field programmable gate array (FPGA), and conventional circuit modules arranged to perform the recited functions.

The invention claimed is:

1. A sheet feeding device to feed a sheet in a feed direction, the device comprising:

a loading portion on which the sheet is to be placed;

a feeler to rotate from a reference position to a pushed position around a support shaft in response to a push by a downstream end of the sheet, which is placed on the loading portion, in the feed direction;

a first detection sensor to detect a rotation of the feeler from one of the reference position and the pushed position to the other of the reference position and the pushed position, the loading portion including a second detection sensor to detect a state in which the sheet is placed on the loading portion; and a roller configured to start a sheet feeding operation, in response to the second detection sensor continuously detecting a state in which the sheet is placed on the loading portion even when the first detection sensor detects the rotation of the feeler from the reference position to the pushed position and then detects a rotation of the feeler from the pushed position to the reference position, the second sensor being upstream of the first sensor in the feed direction, and further configured to detect the sheet is at a feeding position of the loading portion.

2. The sheet feeding device according to claim 1, wherein the second detection sensor is disposed upstream from the feeler in the feeding direction.

3. The sheet feeding device according to claim 1, wherein the second detection sensor is a reflection-type photosensor disposed such that a detection surface of the reflection-type photosensor is positioned on a same plane as or lower than a loading surface of the loading portion.

4. The sheet feeding device according to claim 1, further comprising another feeler configured to rotate around another support shaft from a protruding position at which said another feeler protrudes from a loading surface of the loading portion to a non-protruding position at which said another feeler does not protrude from the loading surface, wherein the second detection sensor is a transmission-type photosensor to configured to detect a rotation of said another feeler from one of the protruding position and the non-protruding position to the other of the protruding position and the non-protruding position.

5. The sheet feeding device according to claim 1, wherein the sheet feeding device is attachable to an image forming apparatus, and wherein when the second detection sensor is configured to detects the state where the sheet is placed on the loading portion during execution of a power saving mode in which power consumption in the image forming apparatus is controlled to be lower than during execution of printing, the sheet feeding device being configured to cancel the power saving mode to return the image forming apparatus to a normal power mode for printing.

6. The sheet feeding device according to claim 1, wherein the loading portion includes a lifting loading portion configured to raise the sheet placed on the loading portion from a standby position to a feeding position based on a sheet feeding operation starting, and wherein based on the second detection sensor detecting the state in which the sheet is placed on the loading portion, the lifting loading portion is configured to be lifted from the standby position to the feeding position.

7. The sheet feeding device according to claim 6, wherein lift loading portion is configured to raise the sheet to be in contact with the roller in the feeding position.

8. The sheet feeding device according to claim 1, wherein the second detection sensor is configured to detect a state in which all of a plurality of sheets placed on the loading portion are depleted.

9. The sheet feeding device according to claim 1, wherein the support shaft is lower than a loading surface of the loading portion.

10. The sheet feeding device according to claim 1, wherein the sheet feeding device is a document feeder in which a document as the sheet is to be placed on the loading portion.

11. An image forming apparatus comprising the sheet feeding device according to claim 1.

* * * * *